United States Patent [19]

Dugas

[11] 4,010,712

[45] Mar. 8, 1977

[54] COATING APPLICATOR TOOL FOR WELL CASING

[75] Inventor: Michael G. Dugas, Baton Rouge, La.

[73] Assignee: Ethyl Corporation, Richmond, Va.

[22] Filed: Nov. 12, 1975

[21] Appl. No.: 631,034

[52] U.S. Cl. ..... 118/306; 239/337

[51] Int. Cl.² ..... B05C 7/02

[58] Field of Search ..... 118/306, 317, DIG. 10; 166/173

[56] References Cited

UNITED STATES PATENTS

| | | | |
|---|---|---|---|
| 42,600 | 5/1864 | Ross | 118/317 |
| 2,852,080 | 9/1958 | Roach | 118/306 X |
| 3,606,862 | 9/1971 | Huff et al. | 118/DIG. 10 |

*Primary Examiner*—Louis K. Rimrodt

*Attorney, Agent, or Firm*—Donald L. Johnson; John F. Sieberth; James M. Pelton

[57] ABSTRACT

A protective coating applicator tool for application of coating material to the interior of well casing.

10 Claims, 4 Drawing Figures

COATING APPLICATOR TOOL FOR WELL CASING

BACKGROUND OF THE INVENTION

In the recovery of natural brines, oil, gas and the like from producing wells, a major problem is corrosion of the well casing from attack by constituents in the product. Such attack has been estimated to cause more than 2 billion dollars worth of damage annually. If some method of preventing such damage is not employed, the corrosive effects over a period of time will corrode the well casing. The casing must then be repaired by inserting a liner at the damaged section of casing. Once a liner is installed, smaller production tubing is required. Such procedures are expensive, result in considerable periods of lost production time with the well being out of service and if a liner is set in the casing, the use of smaller equipment for downhole operations is required. Thus, it is desirable to find an efficient and relatively inexpensive means for preventing corrosive attack of extreme service well casing. For example, the formation of a protective passive film of oxides is not possible because of the water and/or hydrocarbon fluids passing through the well which carry off the oxides formed. Thus, the use of film-forming or reactive-type corrosion inhibitors has been found to be the most practical although less than completely satisfactory method of protecting well casing.

In general, use of corrosion inhibitor has involved excessive amounts of material relative to the coating applied, much of which is wasted, and presents problems of contaminating the well product or plant processing equipment. For example, corrosion inhibitor has previously been pumped directly into open well casing, or pumped through the production tubing. Another method of application is to pull the production tubing and run a swab cup, a close fitting solid rubber flange, down the well pouring inhibitor down after it and swabbing down the casing on pulling up the swab cup.

None of the prior art methods described above allow close control over the coating thickness and allow application under controlled conditions. It is believed that the present invention offers advantages of using only enough inhibitor to do the job, application of corrosion inhibitor under controlled conditions and reducing product and process equipment contamination problems.

In accord with the present invention, there is provided an apparatus which allows the application of a relatively uniform coating of corrosion inhibitor to oil, gas, brine and similar wells having corrosion problems which has the advantage of using only enough material to place the desired coating on the well casing and, hence, causes less interference with process control and product contamination.

DESCRIPTION OF THE DRAWINGS

The apparatus provided by the present invention is illustrated in the accompanying drawings of which

THE INVENTION

According to the present invention there is provided an apparatus for the application of an interior protective coating to well casing in-place which comprises, in combination, a spray section and a container section, said container section including means for releasable attachment to said apparatus of a lowering line, a container head having an end wall defining the upper portion of the container, said container head end wall having filling and pressurizing means, vent means and pressure relief means, a pressure container and a container bottom having an end wall defining the lower portion of said container, said container bottom end wall having an outlet communicating with said spray section, said spray section having at least one spray nozzle connected through a conduit, said conduit containing a pressure regulated flow control valve means, to the container bottom end wall and communicating with the container section through said outlet in said container bottom end wall.

Figure 1:
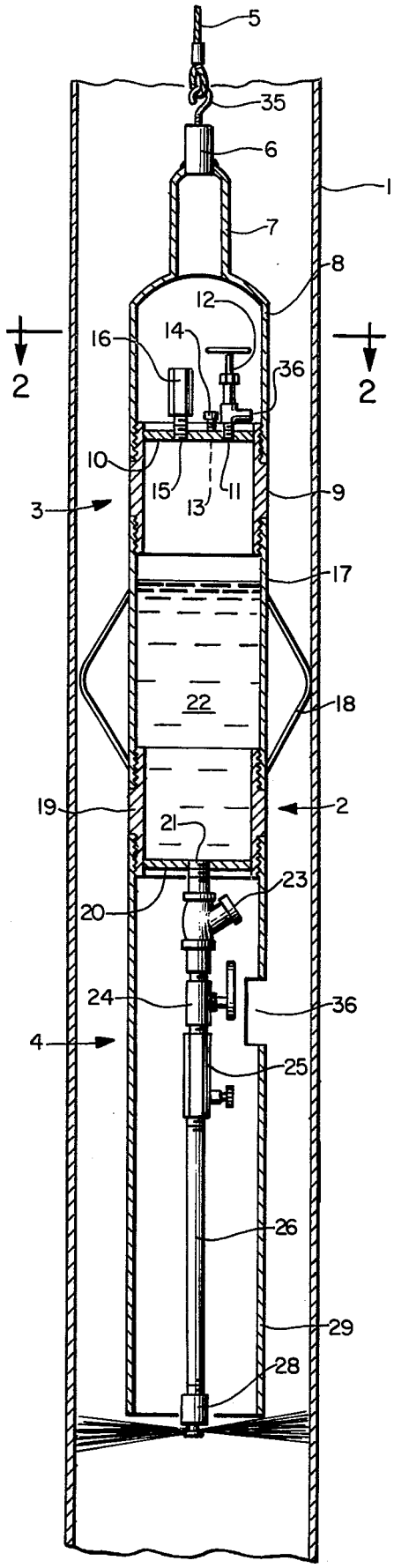
FIG. 1 is a cross-sectional view of the apparatus in operation in a well casing.

The apparatus of the present invention can be more particularly illustrated by reference to the accompanying drawings. In FIG. 1, there is illustrated an operational mode of the apparatus of the present invention. The apparatus 2 is lowered into well casing 1 and generally includes a container section 3 and spray section 4. The apparatus 2 is lowered in well casing 1 by means of a wire line 5 attached to connector 6 by conventional means, such as an eye bolt or wire line connector 35. In turn, connector 6 is attached to the upper end of a conventional fishing neck 7, the lower end of which is attached to top cap 8. Top cap 8 is releasably and, preferably threadedly, attached to pressure container 17 by means of pressure container head 9 and functions to protect and provide access to the valving for filling the pressure container 17 as well as serve as an attachment location for the lowering mechanism, not shown. Pressure container head 9 has as its upper end pressure container head end wall 10 defining the upper portion of the pressure container 17 and pressure container head end wall 10 has filling inlet 11, vent 13, not shown because of its offset location in FIG. 1, and pressure relief hole 15 disposed therein into which are secured, respectively, filling valve 12, vent means 14 and pressure relief valve 16. For convenience, pressure container head 9 is releasably, and preferably threadedly, attached to pressure container 17 in order to allow cleaning of the pressure container 17. Pressure container 17 has attached to its lower end pressure container bottom 19, also releasably and, preferably, threadedly attached, to pressure container 17. Pressure container bottom end wall 20 defining the lower portion of pressure container 17 has therein outlet 21 which completes the container section 3. As illustrated in the embodiment shown in FIG. 1, pressure container 17 holds a fluid protecting material 22, for example, corrosion inhibitor which is commercially available, in the apparatus under sufficient pressure to force the material 22 through spray section 4 on operation of the appropriate control.

Spray section 4 includes a filter or strainer 23 connected, preferably by threaded engagement, to outlet 21 at one end and to actuating valve 24 at the other end. Actuating valve 24 serves an on/off control function for activation of the apparatus. At its other end, actuating valve 24 is attached to pressure compensated flow control valve 25 which serves to maintain a constant flow to spray nozzle 28 through extension conduit 26. Extension conduit 26 is not required for operation of the apparatus 2, but is convenient for allowing insertion of apparatus 2 a sufficient distance into the well casing 1 so that on actuating the apparatus 2 the coating material is not sprayed over the working area. The length of extension conduit 26 is not critical but should be long enough, as mentioned above, to allow the apparatus 2 to be placed into the well casing 1 and actuating valve 24 to be turned on and the spray started in the well casing 1 without, for example, spraying corrosion inhibitor on the working area. The spray section 4 is enclosed within an openended protective shell 29 for protection of the spray section valving and to provide a connection for end cap 31 (shown in FIG. 3). Access to actuating valve 24 can be had by removal of protective shell 29 or through aperture 36.

In operation, top cap 8 is disconnected from pressure container head 9, the unit is filled, top cap 8 is replaced, and then apparatus 2 is attached to wire line 5. A suitable fluid protecting material 22 is introduced through filling valve 12 by means of filling valve inlet 36, after vent means 14 is opened to allow the air inside pressure container 17 to escape. On the addition of the desired amount fluid protecting material 22 to pressure container 17, the vent means 14 is closed, thus blocking the vent 13 and valve inlet 36 is connected to a source of pressurized gas. Any gas inert to the fluid protecting material can be used such as air, nitrogen, the inert gases and the like. The fluid protecting material 22 is pressurized to the desired pressure, depending upon the amount of material included, the total volume of pressure container 17, pressure container head 8 and pressure container bottom 19, and the physical characteristics of the selected spray nozzle or nozzles. For example, pressures from 100 to 500 psig and preferably about 150 psig are useful. Pressure relief valve 16 is set arbitrarily at a value of 2 percent above the desired pressure to protect apparatus 2 from overpressuring. When filling and pressuring have been completed, the top cap 8 is reconnected and the apparatus 2 is set in the well casing so that the spray nozzle 28 is just below the top of the well casing 1. Actuating valve 24 is turned on and the flow and spray pattern are observed. The flow rate has been previously determined. The flow rate through pressure regulated flow control valve 25 should be preset to the desired rate. Although shown with a manual adjustment knob in FIG. 1, pressure regulated flow control valve 25 can be preset in the manufacture of apparatus 2 to any desired flow rate and the manual adjustment knob for pressure regulated flow control valve 25 can be omitted. If flow and spray pattern are satisfactory the apparatus 2 is lowered on wire line 5 into well casing 1 at a predetermined speed for application of the desired amount of fluid protecting material 22 to the interior of well casing.

If the well casing is relatively close in size to apparatus 2, it will not be necessary to maintain apparatus 2 in the center of well casing 1 for application of a substantially uniform coating on the interior of well casing 1. However, if well casing 1 is substantially larger than apparatus 2, centralizing means 18 can be attached at appropriate portions of apparatus 2. Such centralizing means 18 are well known for oil field equipment when using small equipment in large well casings and can be attached to the apparatus 2 by conventional methods.

Figure 2:
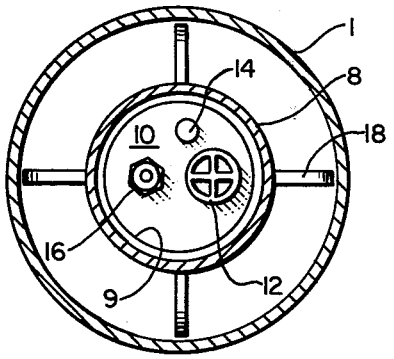
FIG. 2 is a cross-sectional top view along section line 2—2 of FIG. 1 showing the arrangement of the filling, vent and pressure relief means.

FIG. 2 is a cross-sectional top view taken on section line 2—2 of FIG. 1. The cross-section taken through well casing 1 shows top cap 8, pressure container head 9 and end wall 10. In FIG. 2, there is shown an arrangement of the filling valve 12, vent means 14 and pressure relief valve 16 disposed in pressure container head end wall 10. Any particular or desired arrangement of the filling valve 12, vent means 14 and relief valve 16 can be employed as considered practical by one skilled in the art. Also shown are centralizing means 18.

Figure 3:
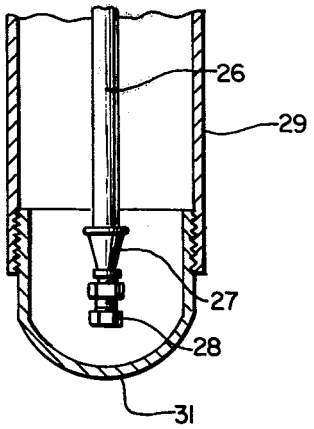
FIG. 3 is a cross-sectional view of the lower end of the spray section of the apparatus having a protective bottom cap in place.

FIG. 3 is a cross-sectional view of the lower end of apparatus 2 showing a portion of spray section 4, particularly protective shell 29 is shown with bottom cap 31 secured to the lower end of the protective shell 29. FIG. 3 also shows another embodiment of spray nozzle 28 in which extension conduit 26 is connected to reducer 27 which in turn is connected to spray nozzle 28. Bottom cap 31 serves to protect the spray nozzle 28 during storage and transportation and is removed in operation.

Figure 4:
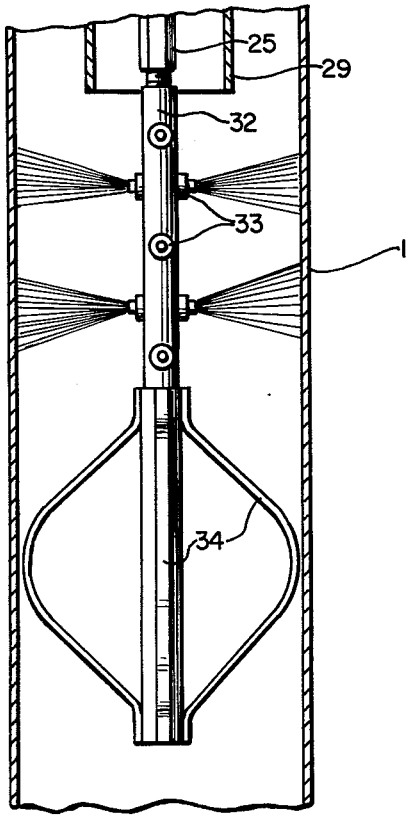
FIG. 4 is a cross-sectional view of the lower end of the spray section showing, as a preferred embodiment, a plurality of spray nozzles and an end centralizer in operation in a well casing.

FIG. 4 shows another embodiment of the lower half of the apparatus 2 and particularly the lower portion of spray section 4 in which a plurality of spray nozzles 33 are arranged on extension conduit 32 to provide a 360° spray pattern for coating well casing 1. Also attached to the lower end of extension conduit 32 is an end centralizer 34 which can be substituted for centralizing means 18 shown in FIG. 1.

Spray nozzle 28 or 33 as shown in FIGS. 1, 3 or 4 can have any desired configuration and those shown are for purposes of illustration only. Commercially available spray nozzles of flat spray, wide flat spray, full-cone, disk-type full-cone, hollow cone, wide spray hollow cone or solid stream spray patterns can be employed depending on the spray pattern desired, pressure employed and the size of the well casing to be treated. The only consideration involved are those of a practical nature including cost and ability to provide a complete coverage in a 360° radius on the well casing as the apparatus is lowered into the well casing.

In use, the assembly can be lowered by any practical and convenient manner into the well casing, including wire line, sand line, swab line or any conventional lowering device which provides control over the rate of descent into the well casing. Control of the rate of descent is important to provide for uniform and complete coverage of well casing by the protecting material and to enable the operator to gage the correct amount of fluid protecting material required for application of a substantially uniform coating. One skilled in the art can easily establish the size of the pressure container as well as the amount of fluid protecting material required by simple calculation when the size and length of the well casing and the thickness of the desired film of protecting material on the well casing is known. The size and materials of construction employed in the present invention depend on the amount of fluid to be sprayed, the pressure to be employed in spraying and the length of well casing to be treated. The pressure container 17 can range from a few feet to 100 or more feet in length, depending on the depth of the well and the thickness of the film of protecting material desired for application to the well casing.

From the foregoing description, it is clear that the apparatus of the present invention can be used for application of corrosion inhibitor to oil well, gas well, brine well, secondary recovery well, injection well, gas-condensate well and similar service where corrosion is a problem. Other applications for the apparatus of the present invention will become readily apparent to those skilled in the art.

From the illustrative description and drawings of particular embodiments of the invention, skilled artisans will readily envision various changes and modifications of the apparatus which can be made without departing from the concept of the invention. Accordingly, it is desired that the present invention be limited only by the scope of the following claims.

What is claimed is:

1. An apparatus for the application of a relatively uniform interior protective coating to well casing in-place which comprises, in combination, a spray section and a container section, said container section including means for releasable attachment to said apparatus of a lowering line, a container head having an end wall defining the upper portion of the container, said container head end wall having filling and pressurizing means, vent means and pressure relief means and a container bottom having an end wall defining the lower portion of the container, said container bottom end wall having an outlet communicating with said spray section, said spray section having at least one spray nozzle connected through a conduit, said conduit containing a pressure regulated flow control valve means, to the container bottom end wall and communicating with the container section through said outlet in said container bottom end wall.

2. The apparatus of claim 1 wherein said apparatus is in the shape of an elongated cylinder.

3. The apparatus of claim 1 further characterized in that said conduit contains filter means and control valve means for on/off operation, between said outlet and said pressure regulated flow control means and said spray section being substantially enclosed by an open-ended protective shell releasably attached to the container bottom, said shell having an aperture therein for access to said control valve means.

4. The apparatus of claim 1 wherein said conduit has a plurality of spray nozzles adapted to provide a 360° spray pattern.

5. The apparatus of claim 1 being adapted to fit larger well casings by the use of centralizers securably attached to the lateral portion of said apparatus.

6. The apparatus of claim 1 wherein said apparatus is in the shape of an elongated cylinder and said conduit contains filter means and control valve means for on/-off operation between said outlet and said pressure regulated flow control valve means, said spray section being substantially enclosed by an open-ended protective shell releasably attached to the container bottom, said shell having an aperture therein for access to said control valve means.

7. The apparatus of claim 1 further characterized in that said conduit contains a filter means and control valve means for on/off operation between said outlet and said pressure regulated flow control valve means, said spray section being substantially enclosed by an open-ended protective shell releasably attached to said container bottom, said shell having an aperture therein for access to said control valve means, and said conduit having a plurality of spray nozzles adapted to provide a 360° spray pattern.

8. The apparatus of claim 1 further characterized in that said apparatus is in the shape of an elongated cylinder and said conduit contains filter means, control valve means for on/off operation connected between said outlet and pressure regulated flow control valve means, said spray section being substantially enclosed by an open-ended protective shell releasably attached to said container bottom, said shell having an aperture therein for access to said control valve means, and said conduit having a plurality of spray nozzles adapted to provide a 360° spray pattern.

9. The apparatus of claim 1 further characterized in that said apparatus is in the shape of an elongated cylinder adapted to fit larger well casings by the use of centralizers securably attached to the lateral portion of said apparatus.

10. The apparatus of claim 1 being further characterized in that said apparatus is in the shape of an elongated cylinder and said conduit contains a filter means and a control valve means for on/off operation connected between said outlet and said pressure regulated flow control valve means, said spray section being substantially enclosed by an open-ended protective shell releasably attached to the container bottom, said shell having an aperture therein for access to said control valve means, said apparatus being adapted to fit larger well casings by the use of centralizers securably attached to the lateral portion of said apparatus.

* * * * *